US006281173B1

(12) United States Patent
Tanaka et al.

(10) Patent No.: US 6,281,173 B1
(45) Date of Patent: Aug. 28, 2001

(54) TWO-STROKE MOTORCYCLE LUBRICANT

(75) Inventors: Yas Tanaka, Reading; Paul Fritz-Johnson; Howard Silver, both of Oxfordshire; David James Atkinson, Reading, all of (GB)

(73) Assignee: Castrol Limited, Wiltshire (GB)

( * ) Notice: Subject to any disclaimer, the term of this patent is extended or adjusted under 35 U.S.C. 154(b) by 0 days.

(21) Appl. No.: 09/403,936

(22) PCT Filed: Apr. 29, 1998

(86) PCT No.: PCT/GB98/01082

§ 371 Date: Jan. 19, 2000

§ 102(e) Date: Jan. 19, 2000

(87) PCT Pub. No.: WO98/49254

PCT Pub. Date: Nov. 5, 1998

(30) Foreign Application Priority Data

Apr. 29, 1997 (GB) ..... 9708628

(51) Int. Cl.[7] ..... C10M 101/02; C10M 149/00

(52) U.S. Cl. ..... 508/110; 508/545; 508/561; 508/562; 585/13

(58) Field of Search ..... 585/13; 508/110

(56) References Cited

U.S. PATENT DOCUMENTS

| | | | | |
|---|---|---|---|---|
| 3,753,905 | | 8/1973 | Souillard | 252/33.4 |
| 4,100,082 | * | 7/1978 | Clason et al. | 252/33.4 |
| 4,200,545 | * | 4/1980 | Clason et al. | 252/33.4 |
| 4,425,138 | * | 1/1984 | Davis | 44/58 |
| 4,759,860 | * | 7/1988 | Tanaka et al. | 252/32.5 |
| 5,049,291 | * | 9/1991 | Miyaji et al. | 252/33 |
| 5,308,524 | * | 5/1994 | Miyaji et al. | 252/51.5 A |
| 5,321,172 | | 6/1994 | Alexander | 585/2 |
| 5,330,667 | | 7/1994 | Tiffany | 252/49.6 |
| 5,475,171 | * | 12/1995 | McMahon et al. | 585/2 |
| 5,498,353 | | 3/1996 | Lin | 252/33.4 |
| 5,624,890 | * | 4/1997 | Kagaya et al. | 508/561 |
| 5,888,948 | * | 3/1999 | Meny et al. | 508/591 |
| 5,965,498 | * | 10/1999 | Smythe | 508/468 |
| 6,093,861 | * | 7/2000 | Muntz | 585/13 |

FOREIGN PATENT DOCUMENTS

| | | |
|---|---|---|
| 2187894 | 1/1974 | (FR) . |
| 973679 | 10/1964 | (GB) . |
| 0714972 | 6/1996 | (JP) . |
| WO 92 21736 | 12/1992 | (WO) . |
| WO 96 17907 | 6/1996 | (WO) . |

OTHER PUBLICATIONS

Patent Abstracts of Japan, vol. 095, No. 010, Nov. 30, 1995 and JP 07 179869 A (KAO Corp.) Jul. 18, 1995.

* cited by examiner

*Primary Examiner*—Ellen M. McAvoy
(74) *Attorney, Agent, or Firm*—Nixon & Vanderhye

(57) ABSTRACT

A two-stroke motorcycle lubricant comprising a base oil having a viscosity at 100° C. of less than 8 cSt and a pour point below −30° C., preferably below −39° C. The two-stroke motorcycle lubricant further comprises a detergent system based on an ashless, oil-soluble amine. The two-stroke motorcycle lubricant exhibits high levels of cleanliness and low levels of exhaust smoke, whilst maintaining high load carrying capacity. The two-stroke motorcycle lubricant may be dyed.

21 Claims, No Drawings

TWO-STROKE MOTORCYCLE LUBRICANT

CROSS-REFERENCE TO RELATED APPLICATION

This is a U.S. National Phase of International application no. PCT/GB98/01082 filed Apr. 29, 1998.

BACKGROUND AND SUMMARY OF THE INVENTION

This invention concerns a two-stroke motorcycle lubricant.

The function of a lubricant in a two-stroke motorcycle engine is to lubricate and cool moving parts. In a two-stroke motorcycle engine lubricant is burnt along with a fuel charge, which leaves deposits of burnt products in the exhaust, the exhaust port, the combustion chamber and on the piston. These deposits lead to a decrease in the engine performance and they reduce the total working life of the engine, and the exhaust.

Modern two-stroke lubricants usually comprise a balance of additives in a base oil, with a thickener and solvent.

The additives are normally detergents, dispersants and antioxidants. The detergents are oil soluble metallic soaps such as sulphonates or phenates. An example of a detergent that could be used is Hitec 614, which is available from The Ethyl Corporation. Fully formulated additive packages such as Lubrizol 600, which is available from The Lubrizol Corporation, are also used. Lubrizol 600 contains a phenate soap detergent and a succinimide dispersant. The detergents or formulated additive packages are added to lubricants to minimise the build up of deposits.

The base oils are carriers for the additives and they aid in the load carrying capability of the lubricant. The base oils are normally mineral based having a pour point of greater than −12° C. A lubricant cannot just comprise a mineral base oil and additives because it would not pass the JASO smoke test FC level (see later for details of the test). In order to pass the JASO smoke test FC level, a polyisobutene (PIB) thickener is added. Polyisobutene has a very low smoke level relative to mineral oil which enables the lubricant to pass the test. The PIB is usually required in a concentration of greater than 20%. Finally, if a high viscosity base oil is used in the lubricant, a hydrocarbon solvent, such as white spirit, is required to aid miscibility with the fuel. Typically the concentration of the solvent is around 20%.

Current lubricants have disadvantages that can affect the longevity of the engine. Normal detergent additive chemistries are ash-containing, i.e. they are based on metallic sulphonate or phenate soaps, which can lead to increased deposit formation in the combustion chamber and spark plug whiskering, i.e. a build-up of metallic salts or "ash" on the spark plug electrode. These effects can lead to starting problems, reduced performance and possible engine damage.

The mineral base oils that are routinely chosen for two-stroke lubricants lead to deposits (i.e. decomposition products) that can block the exhaust port and progressively clog the exhaust. This leads to reduced top speed and increased fuel consumption, giving poor combustion and increased emissions.

The lubricity or load carrying capability of two-stroke lubricants is generally acceptable and seizures are uncommon. However, the adequate lubricity of the lubricant is often offset by relatively poor detergency. A good two-stroke lubricant needs all round performance.

These effects described above can occur in less than 5000 km, causing decreased engine performance and possibly even causing damage to the motorcycle engine.

A further disadvantage for the lubricant manufacturer is the dark colour of finished two-stroke lubricants comprising mineral base oils and metallic soap detergents. Dark coloured lubricants may be perceived by the consumer to be of a lower quality or to contain used oils. It is difficult for the manufacturer to dye dark oils.

The aim of the present invention is to provide further detergents and base oils for a two-stroke motorcycle lubricant.

It is a further aim of the present invention to provide a detergent that will not block exhausts and catalysts, and will maintain excellent levels of cleanliness and very low levels of exhaust smoke, whilst maintaining high load carrying capacity.

In accordance with the present invention there is provided a two-stroke motorcycle lubricant comprising a base oil having a viscosity at 100° C. of less than 8 cSt and a pour point below −30° C., preferably below −39° C.

In accordance with the present invention there is also provided use of an ashless, oil-soluble amine as a detergent in a two-stroke motorcycle lubricant.

The oil-soluble amine is referred to as an ashless, oil-soluble amine because it does not contain any metallic functionality.

The viscosity of the base oil at 100° C. is preferably below 6 cSt, more preferably below 4 cSt, and even more preferably around 2 cSt. The base oil is preferably a mineral oil derived from a naphthenic crude source or a polyalphaolefin.

The ashless, oil-soluble amine preferably has a molecular weight of at least 450, more preferably in the range 900–1500. The ashless, oil-soluble amine is preferably: a polyisobutene-amine; a polyisobutene-phenolamine; a polyetheramine; or a combination thereof.

The inventor has found that if he uses a detergent comprising an ashiess, oil-soluble amine in combination with base oils having low viscosity (i.e. less than 8 cSt at 100° C.) and low pour point (i.e. below −30° C.) in a two-stroke motorcycle lubricant, the two-stroke motorcycle lubricant exhibits excellent detergency, there is a reduction in the blocking of exhausts and catalysts, and very low levels of smoke are produced. Furthermore, the lubricants are extremely light in colour, they are attractive to the consumer, and they are capable of being dyed different colours by the manufacturer.

The two-stroke motorcycle lubricant may also include a thickener. The thickener is preferably a polyisobutene, preferably having a molecular weight of greater than 450, more preferably greater than 950. The thickener is more preferably a reactive polyisobutene, preferably having a molecular weight of greater than 450, more preferably greater than 950. A reactive polyisobutene differs from a standard polyisobutene in that at least 80% of the terminal unsaturation is in the alpha position. Suitable conventional polyisobutenes are Hyvis 07 and Hyvis 10, and suitable reactive polyisobutenes are Ultravis 5 and Ultravis 10, all of which are available from BP Chemicals. The polyisobutene thickener is added to the two-stroke lubricant to increase the viscosity without having a detrimental effect on smoke and deposit formation. High viscosity mineral base oils may be used to increase a lubricant's viscosity, but they have a negative effect on smoke and deposit formation.

DETAILED DESCRIPTION OF THE INVENTION

The invention will now be described with reference to the following examples:

EXAMPLES

The base oils used in the examples are described in the following table:

| | Base oil type | Viscosity @ 100° C./cSt ASTM D445 | Pour point/° C. ASTM D97 |
|---|---|---|---|
| BP 60 Spindle, available from BP Oils | Naphthenic | 2.3 typical | −40 max |
| Nynas T9, available from Nynas | Naphthenic | 2.0 typical | −57 |
| Nynas NS100, available from Nynas | Naphthenic | 8.4 typical | −24 typical |
| PAO 2, available from Mobil | Polyalphaolefin | 1.6–1.8 | −60 |
| PAO 8, available from Mobil | Polyalphaolefin | 7.7–8.2 | −54 |
| BP 500 SN, available from BP Oils | Solvent neutral mineral | 10.8 typical | −9 max |

The additives used in the examples are described in the following table:

| | |
|---|---|
| ADX 3866, available from Adibis | Detergent package containing 38% of polyether, and 14% of ADX251C polyisobutene-amine (see below) |
| ADX 251C, available from Adibis | Polyisobutene-amine (PIB-amine) |
| ADX 4009, available from Adibis | Polyisobutene-phenolamine (PIB phenol-amine) |
| Lubrizol 600, available from The Lubrizol Corporation | Conventional 2 stroke additive package containing calcium phenate detergent and polyisobutene-succinimide dispersant |
| Paratemps 8 available from Paramins | Conventional 2 stroke additive package containing calcium detergent and polyisobutene-succinic anhydride based dispersant |

The lubricants were blended by adding the base oil to a suitable blending vessel, and adding the thickener. The mixture was agitated using either a mixer or blown air, and the mixture was warmed to 65° C. The mixture was then cooled to below 30° C. and the ashless detergent system was added. The conventional additives such as Lubrizol 600 or Paratemps 8 were blended in at 65° C.

Example 1

Two-stroke motorcycle lubricants were prepared and their performance was tested.

The performance of the lubricant was determined using the JASO standards and an ISO detergency standard that are currently used on commercially available two-stroke motorcycle lubricants. There are four levels of performance: JASO FA; FB; FC; and ISO EGD. JASO FA is the lowest standard and ISO EGD is the highest standard.

The performance criteria that determine the quality of a two-stroke motorcycle lubricant are set out in the JASO engine test sequences, details of which are available from the Japanese Automotive Standards Organisation. A short summary on each test is given below. The tests determine the two-stroke motorcycle lubricant's performance in comparison to a reference two-stroke motorcycle lubricant of known quality, and they give the result as an index number. The parameters that are measured are:

JASO Exhaust System Blocking Test (JASO M-343-92)

This test determines the two-stroke motorcycle lubricant's potential for the breakdown products on combustion to build up to such a degree that they affect the engines performance, possibly causing failure, more likely reducing top speed and increasing fuel consumption.

This is referred to as Blocking index (BIX). The minimum index result for JASO FC standard is 90 and the minimum index result for JASO FB standard is 45.

JASO Detergency Test (JASO M-341-92)

This test determines the high temperature detergency of the two-stroke motorcycle lubricant. The two-stroke motorcycle lubricant's ability to control deposits on the piston, focusing on the piston ring grooves, is also evaluated. This is referred to as the Detergency index (DIX). The minimum index result for JASO FC standard is 95 and the minimum index result for JASO FB standard is 85.

JASO Smoke Test (JASO M-342-92)

This test determines the amount of smoke formed when the two-stroke motorcycle lubricant is burnt.

This is referred to as the Smoke index (SIX). The minimum index result for JASO FC standard is 95 and the minimum index result for JASO FB standard is 45.

JASO Lubricity Test (JASO M-340-92)

The lubricity test determines the load carrying capability of the two-stroke motorcycle lubricant at elevated temperatures.

The minimum index result for JASO FC standard is 95 and the minimum index result for JASO FB standard is 95.

CEC ISO EGD Detergency Test (CEC L-079-X-94)

This test is an extension of the JASO detergency test, however, it is more severe and has higher pass limits. Details of this test are available from the Co-ordinating European Council (CEC).

This is referred to as the EGD detergency index, and piston skirt cleanliness index (EGD DIX and PIX). The ISO standard is 125 minimum DIX and 95 minimum PIX.

| | Description | Formulation 1 | Comparative Formulation 2 |
|---|---|---|---|
| ADX 3866 | Ashless detergent package | 30% | |
| Ultravis 10 | Thickener | 33% | |
| 60 Spindle | 2 cSt Naphthenic base oil | 37% | |
| Paratemps 8 | Conventional two-stroke detergent/ dispersant package | | 4.5% |
| Brightstock | Base oil | | 10% |
| 500 Solvent Neutral | Base oil | | 75.5% |
| White Spirit | Solvent | | 10% |
| Test results | | | |
| Blocking Index | | 342 | 75 |
| ISO EGD Detergency index | | 144 | |
| JASO Detergency Index | | 114 | 85 |

The minimum performance for JASO FC in the blocking index test is 90; and the minimum performance for JASO FB is 45. The minimum performance in the detergency test is 95 for FC level and 85 for FB level. Comparative Formulation 2 is classed as a JASO FB oil. Formulation 1 greatly exceeds the limits for JASO FC.

Example 2

The following two-stroke motorcycle lubricants show the advantage of using a low viscosity, low pour point base oil in place of standard mineral solvent neutral stocks:

| | Description | Formulation 3 | Comparative Formulation 4 |
|---|---|---|---|
| ADX 251C | PIB-amine | 4.2% | 4.2% |
| ADX 4009 | PIB-phenolamine | 1.54% | 1.54% |
| Nynas T9 | 2 cSt naphthenic base oil | 61.26% | |
| SN 500 | Solvent neutral mineral base oil | | 61.26% |
| Ultravis 10 | PIB thickener | 33% | 33% |
| Test Results | | | |
| Lubricity index | | 115 | 91 |
| Blocking index | | 236 | 224 |
| Smoke index | | 199 | 50 |
| ISO EGD detergency index | | 152 | 101 |
| Piston Skirt index | | 104 | 100 |

Comparing the JASO test results for Formulation 3 with Comparative Formulation 4, the results show that by replacing a standard solvent neutral mineral stock with a naphthenic base oil having low pour point and low viscosity, the performance in the JASO tests can be improved.

Example 3

The following two-stroke motorcycle lubricants show the benefit of using low viscosity base oils:

| | Description | Formulation 5 | Formulation 6 |
|---|---|---|---|
| ADX 251C | PIB-amine | 4.2% | 4.2% |
| ADX 4009 | PIB-phenolamine | 1.54% | 1.54% |
| Nynas NS100 | 8 cSt naphthenic base oil | 61.26% | |
| Nynas T9 | 2 cSt naphthenic base oil | | 61.26% |
| Ultravis 10 | PIB thickener | 33% | 33% |
| Test results | | | |
| Lubricity index | | 96 | 115 |
| Blocking index | | 163 | 236 |
| Smoke index | | 48 | 199 |
| ISO EGD detergency index | | 142 | 152 |
| Piston Skirt index | | 104 | 104 |

The results for Formulation 6 clearly show the advantages of using a 2 cSt base oil in the JASO tests when compared to Formulation 5 which uses an 8 cSt base oil.

Example 4

The following two-stroke motorcycle lubricants show the benefit of low viscosity base oils:

| | Description | Formulation 7 | Formulation 8 |
|---|---|---|---|
| ADX 251C | PIB-amine | 4.2% | 4.2% |
| ADX 4009 | PIB-phenolamine | 1.54% | 1.54% |
| PAO 8 | 8 cSt polyalpha-olefin base oil | 61.26% | |
| PAO 2 | 2 cSt polyalpha-olefin base oil | | 61.26% |
| Ultravis 10 | PIB thickener | 33% | 33% |
| Test results | | | |
| Lubricity index | | 107 | 111 |
| Blocking index | | 328 | 344 |
| Smoke index | | 66 | 183 |
| ISO EGD detergency index | | 133 | 132 |
| Piston Skirt index | | 97 | 107 |

Again, the results for Formulation 8 clearly show the advantages of using a low viscosity (2 cSt) base oil in the JASO tests when compared to Formulation 7 which uses an 8 cSt base oil.

Example 5

The following two-stroke motorcycle lubricants show the advantage of using the ashless, oil-soluble amine detergent in place of a conventional two-stroke detergent system:

| | Description | Formulation 9 | Comparative Formulation 10 |
|---|---|---|---|
| ADX 251C | PIB-amine | 4.2% | |
| ADX 4009 | PIB-phenolamine | 1.54% | |
| Lubrizol 600 | Conventional two-stroke additive | | 4.2% |
| PAO 2 | 2 cSt polyalpha-olefin base oil | 61.26% | 62.8% |
| Ultravis 10 | PIB thickener | 33% | 33% |

-continued

| | Description | Formulation 9 | Comparative Formulation 10 |
|---|---|---|---|
| Test result | | | |
| Blocking index | | 344 | 312 |

| | Description | Formulation 11 | Comparative Formulation 12 |
|---|---|---|---|
| ADX 251C | PIB-amine | 4.2% | |
| ADX 4009 | PIB-phenolamine | 1.54% | |
| Lubrizol 600 | Conventional two-stroke additive | | 4.2% |
| PAO 8 | 8 cSt polyalpha-olefin base oil | 61.26% | 62.8% |
| Ultravis 10 | PIB thickener | 33% | 33% |
| Test result | | | |
| Blocking index | | 328 | 256 |

The results show that blocking performance can be improved by the use of the ashless, oil-soluble amine detergent in place of a convention al two-stroke detergent package.

Example 6

The following two-stroke motorcycle lubricants show the advantage in lubricant colour of using a highly refined base oil with an ashless, oil-soluble amine detergent over a conventional two-stroke lubricant:

| | Description | Formulation 13 | Comparative Formulation 14 |
|---|---|---|---|
| ADX 3866 | Formulated detergent package | 30% | |
| BP 60 Spindle | Naphthenic base oil | 37% | |
| Ultravis 5 | PIB thickener | 33% | |
| Paratemps 8 | Conventional two-stroke additive package | | 4.5% |
| Brightstock | Mineral base oil | | 10% |
| BP 500 SN | Mineral solvent neutral base oil | | 75.5% |
| White spirit | Hydrocarbon solvent | | 10% |
| ASTM Colour test | | | |
| ASTM D1500 | | Less than 1.0 | 3 |

The colour of the Formulation 13 using the ashless, oil-soluble amine as a detergent is much lighter than the conventional lubricant (Comparative Formulation 14) as measured in the ASTM colour test.

What is claimed is:

1. A method of lubricating a two-stroke motorcycle engine comprising:

(a) providing to a two-stroke motorcycle engine as a base oil lubricant a mineral oil derived from a naphthenic crude source having a viscosity of 100° C. of less than 4 cSt and a pour point below −30° C., so as to improve detergency, reduce blocking of exhausts and catalysts, and produce low levels of smoke.

2. A method as recited in claim 1 wherein (a) is further practiced by providing a mineral oil having a pour point below −39° C.

3. A method as recited in claim 1 wherein (a) is further practiced to provide a mineral oil having a viscosity at 100° C. of around 2 cSt.

4. A method as recited in claim 1 wherein (a) is further practiced using as a lubricant an ashless, oil-soluble amine as a detergent system.

5. A method as recited in claim 4 wherein (a) is further practiced using an ashless, oil-soluble amine having a molecular weight of at least 450.

6. A method as recited in claim 4 wherein (a) is further practiced using an ashless, oil-soluble amine having a molecular weight in the range of 900–1500.

7. A method as recited in claim 4 wherein (a) is further practiced using a polyisobutene-amine as the ashless, oil-soluble amine.

8. A method as recited in claim 4 wherein (a) is further practiced using a polyisobutene-phenolamine as the ashless, oil-soluble amine.

9. A method as recited in claim 4 wherein (a) is further practiced using a polyetheramine as the ashless, oil-soluble amine.

10. A method as recited in claim 4 wherein (a) is further practiced using a combination of polyisobutene-amine as the ashless, oil-soluble amine, polyether amine, or polyisobutene-phenolamine.

11. A method as recited in claim 1 wherein (a) is further practiced using a lubricant capable of being dyed.

12. A method as recited in claim 6 wherein (a) is further practiced using a combination of polyisobutene-amine as the ashless, oil-soluble amine, polyetheramine, or polyisobutene-phenolamine.

13. A method as recited in claim 6 wherein (a) is further practiced by using as the ashless, oil-soluble amine at least one of a polyisobutene-amine, a polyisobutene-phenolamine, and a polyetheramine.

14. A method as recited in claim 4 wherein (a) is further practiced using as a lubricant an ashless, oil-soluble amine as a detergent system.

15. A method as recited in claim 2 wherein (a) is further practiced using as a lubricant an ashless, oil-soluble amine as a detergent system.

16. A method as recited in claim 15 wherein (a) is further practiced to provide a mineral oil having a viscosity at 100° C. of around 2 cSt.

17. A method as recited in claim 16 wherein (a) is further practiced using an ashless, oil-soluble amine having a molecular weight in the range of 900–1500.

18. A method as recited in claim 17 wherein (a) is further practiced by using as the ashless, oil-soluble amine at least one of a polyisobutene-amine, a polyisobutene-phenolamine, and a polyetheramine.

19. A method as recited in claim 17 wherein (a) is further practiced using a combination of polyisobutene-amine as the ashless, oil-soluble amine, polyetheramine, or polyisobutene-phenolamine.

20. A method as recited in claim 15 wherein (a) is further practiced using an ashless, oil-soluble amine having a molecular weight of at least 450.

21. A method as recited in claim 1 wherein said base oil lubricant consists essentially of at least one mineral oil derived from a naphthenic crude source having a viscosity of 100° C. of less than 4cSt and a pour point of below −30° C.

* * * * *

UNITED STATES PATENT AND TRADEMARK OFFICE

CERTIFICATE OF CORRECTION

PATENT NO. : 6,281,173 B1
DATED : August 28, 2001
INVENTOR(S) : Tanaka et al

It is certified that error appears in the above-identified patent and that said Letters Patent is hereby corrected as shown below:

Column 8,
Line 49, please delete “claim 4” and insert -- claim 3 --.

Signed and Sealed this

Seventh Day of September, 2004

JON W. DUDAS
*Director of the United States Patent and Trademark Office*